US005094733A

United States Patent [19]

Kaneko et al.

[11] Patent Number: 5,094,733

[45] Date of Patent: Mar. 10, 1992

[54] ELECTROLYTIC TREATMENT APPARATUS

[75] Inventors: Nobuyoshi Kaneko; Tsutomu Kakei; Atsushi Matsuura, all of Shizuoka, Japan

[73] Assignee: Fuji Photo Co., Ltd., Kanagawa, Japan

[21] Appl. No.: 487,509

[22] Filed: Mar. 2, 1990

[30] Foreign Application Priority Data

Mar. 14, 1989 [JP] Japan ..... 1-59749

[51] Int. Cl.[5] ..... C25D 17/00

[52] U.S. Cl. ..... 204/206

[58] Field of Search ..... 204/206

[56] References Cited

U.S. PATENT DOCUMENTS 4,500,400 2/1985 Komoda ..... 204/206

FOREIGN PATENT DOCUMENTS 0129338 5/1984 European Pat. Off. .
0140474 7/1984 European Pat. Off. .
2586037 2/1987 France .
80791 5/1984 Japan .
266090 11/1988 Japan .

*Primary Examiner*—T. M. Tufariello
*Attorney, Agent, or Firm*—Sughrue, Mion, Zinn, Macpeak & Seas

[57] ABSTRACT

An electrolytic treatment apparatus is provided in which one or more electrolyte discharge outlets and one or more electrolyte supply inlets are provided between main counter electrodes so that the concentration and temperature of the electrolytic treatment solution at the the inlets and at the outlets can be made close to one another. As a result, uniformity and fineness in grains can be maintained, electrolysis efficiency can be raised, and the production speed can be improved.

16 Claims, 2 Drawing Sheets

ELECTROLYTIC TREATMENT APPARATUS

BACKGROUND OF THE INVENTION

The present invention relates to an electrolytic treatment apparatus suitable for providing a rough surface on a metal web by using an AC current, and particularly relates to an electrolytic treatment apparatus for producing a printing-plate support constituted by a rough-surfaced aluminum plate to be used as a offset printing plate.

Aluminum plates have been used as printing-plate supports, particularly, as planographic printing plate supports. Such aluminum plates have been diversified from an aluminum plate formed of substantially pure aluminum to an aluminum plate in which manganese is added to increase the strength of the aluminum plate corresponding to different user applications.

In order to use an aluminum plate as a planographic printing plate support, it is necessary that the aluminum plate have a proper adhesion property to a photosensitive material and a proper water-retention property.

To this end, it is necessary to make the surface of an aluminum plate rough so that the aluminum plate has a uniformly and finely grained surface. This surface-roughing treatment greatly affects the printing performance, such as anti-stain performance, of a plate material printing. Accordingly, the quality of the surface-roughing treatment has been an important factor in producing plate materials.

As a method of performing surface-roughing on an aluminum printing-plate support, it is possible to use one of a mechanical graining method, an electrochemical graining method, or to use those graining methods in combination.

As a mechanical graining method, there are, for example, a ball graining method, a wire graining method, a brush graining method, a liquid horning method, and the like. As an electrochemical graining method, on the other hand, an AC electrolytic etching method has been generally employed. In this case, an electric current of an ordinary sinusoidal waveform, or a special waveform, such as a square waveform, has been used. Further, as pre-treatment for the foregoing electrochemical graining, a chemical etching treatment or oil removing treatment with alkaline solution such as sodium hydroxide or sodium silicate may be performed.

In the AC electrolytic etching method among the foregoing methods, however, there has been a problem in that counter electrodes of carbon, metal, or the like are very easily deteriorated. For example, in the case of using counter electrodes of carbon, deterioration of a binder is significant because oxidation and reduction are repeated every time the polarity changes, and therefore it has been very difficult to perform a stable operation for a long time.

In order to solve the problems, Japanese Patent Examined Publication No. Sho. 61-48596 discloses an electrolytic treatment apparatus which is characterized in that a circuit for an auxiliary counter electrode is connected in parallel to a circuit connected to main counter electrodes, and a diode for controlling an anode current flowing in the main counter electrodes, or a mechanism functioning as such a diode, are provided in the circuit for the auxiliary counter electrode. The electrolytic treatment apparatus has such a configuration as shown in FIG. 2, in which a metal web 1, that is, a material to be treated, is supported on the circumference of a radial drum roller 2, and a clearance between the metal web 1 and each of the main counter electrodes 3*a* and 3*b* disposed in opposition to the metal web 1 is filled with an electrolytic treatment solution 5 containing metal ions in a manner so that the electrolytic treatment solution 5 is supplemented from an electrolyte supply inlet 4 and discharged from an electrolyte discharge outlet 6 to thereby form an electrolyte path 15. An AC current is supplied through electrolyte path 15 from an AC power source to the main counter electrodes 3*a* and 3*b* so as to perform electrochemical treatment. The counter electrodes opposed to the metal web 1 are constituted by the main counter electrodes 3*a* and 3*b* and the auxiliary counter electrode 8; a circuit for the auxiliary counter electrodes 8 and a circuit for making an anode current flow into the main counter electrodes are connected in parallel to a circuit connected to the main counter electrodes 3*a* and 3*b*, and a diode 9 for controlling the anode current flowing in the main counter electrodes or a mechanism functioning as such a diode is provided in the circuit for the auxiliary counter electrode 8 so that currents are made to flow in those circuits.

In this case, the main counter electrodes 3*a* and 3*b* are connected to opposite sides of the AC power source 7 so as to have polarities which are different from each other. Further, each of the main counter electrodes 3*a* and 3*b* is constituted by a large number of small electrodes ($3a_1, 3a_2, 3a_3, \ldots, 3a_n$), ($3b_1, 3b_2, 3b_3, \ldots, 3b_n$) (for example, $n=10$ to 24), each separated from adjacent ones through insulators 10 so as to raise the current efficiency.

In the conventional electrolytic treatment apparatus, however, there has been a problem in that the electrolytic treatment solution 5 supplemented from the electrolyte supply inlet 4 passes through the narrow electrolyte path 15 between the metal web 1 and each of the electrodes 3*a* and 3*b*, and flows into the opposite side of the radial drum roller 2 supply inlet 4 so as to come out the path 15 to the electrolyte discharge outlet 6. This result is that the electrolytic treatment solution gradually fatigues because of electrolysis in the flow path and a component difference is caused between the electrolytic treatment solution at the electrolyte supply inlet 4 and that at the electrolyte discharge outlet 6. This makes it impossible to obtain satisfactory electrolysis efficiency as the whole with the electrolytic treatment apparatus.

Further, a difference between the temperature at the electrolyte supply inlet 4 and that at the electrolyte discharge outlet 6 increases in the vicinity of the metal web so that it is impossible to obtain a desired grained surface.

In the electrolyte path 15, the treatment solution at the metal web 1 side is not sufficiently mixed with the treatment solution at the side of the counter electrodes 3*a* and 3*b* so that the difference in degree of fatigue of the component of the treatment solution between at the metal web side and the counter electrodes side, as well as the temperature difference therebetween, are significant. As a result, unevenness is caused in graining, that is, the electrolytic quality is lowered and the electrolysis efficiency is reduced.

In order to raise the electrolysis efficiency while maintaining uniform and fine grain, therefore, a method has been used in which the flow rate of the treatment solution supplied from the electrolyte supply inlet 4 is increased. In this method, however, the increase in supply of the treatment solution not only causes an increase in cost, but also brings about no sufficiently desirable grain even if the rate of flow of treatment solution is increased.

The foregoing problems become significant when the length of electrolytic treatment is prolonged corresponding to a rise of the line speed, so that there has been a significant limit in increasing the line speed.

SUMMARY OF THE INVENTION

It is therefore an object of the present invention to solve the foregoing problems in the prior art and to thereby provide an electrolytic treatment apparatus in which graining is uniformly and finely performed, and which offers better electrolysis efficiency and is effective in increasing the line speed.

That is, the above object of the present invention can be achieved by an electrolytic treatment apparatus for performing electrolytic treatment continuously on a metal web in an electrolytic treatment solution containing metal ions while supplying an AC current across the metal web and counter electrodes, characterized in that one or more electrolyte discharge outlets and one or more electrolyte supply inlets are provided between main counter electrodes.

The provision of one or more electrolyte discharge outlets and one or more electrolyte supply inlets between the main counter electrodes according to the present invention includes, for example, the provision of one electrolyte discharge outlet and three electrolyte supply inlets, the provision of two electrolyte discharge outlets and three electrolyte supply inlets, and, of course the provision of electrolyte discharge outlets and electrolyte supply inlets which are equal in number to each other.

By the provision of one or more electrolyte discharge outlets and one or more electrolyte supply inlets between the main counter electrodes according to the present invention, the flowing-in/out quantity of the electrolyte treatment solution in the electrolyte path increases. Accordingly, even if the original quality of electrolyte treatment solution is fixed, supplied, and discharged while being circulated, the surface of the metal web existing in the electrolyte path has many opportunities to contact fresh electrolyte treatment solution by mixing and agitating the electrolyte treatment solution during the circulation in comparison with the conventional apparatus. As a result, the grain is made uniform and fine, and the electrolysis efficiency is improved. Further, if fresh electrolyte treatment solution is added to the electrolyte treatment solution to be supplied, it is possible to significantly promote the electrolyte reaction.

Moreover, by the provision of the electrolyte discharge outlets and electrolyte supply inlets, the length of the electrolyte path therebetween is shortened so that the resistance of the path against the flow of solution can be reduced, and the rate of flow of the treatment solution in the path can be made large in comparison with the conventional apparatus to thereby make it possible to further promote the electrolytic reaction. As a result, the grain formed by electrolytic surface-roughing can be made uniform and fine to raise the electrolysis efficiency of the electrolyte treatment apparatus to thereby make it possible to increase the production speed.

DETAILED DESCRIPTION OF THE PREFERRED EMBODIMENT

Referring to the accompanying drawings, an embodiment of the present invention will be described hereunder.

Figure 1:
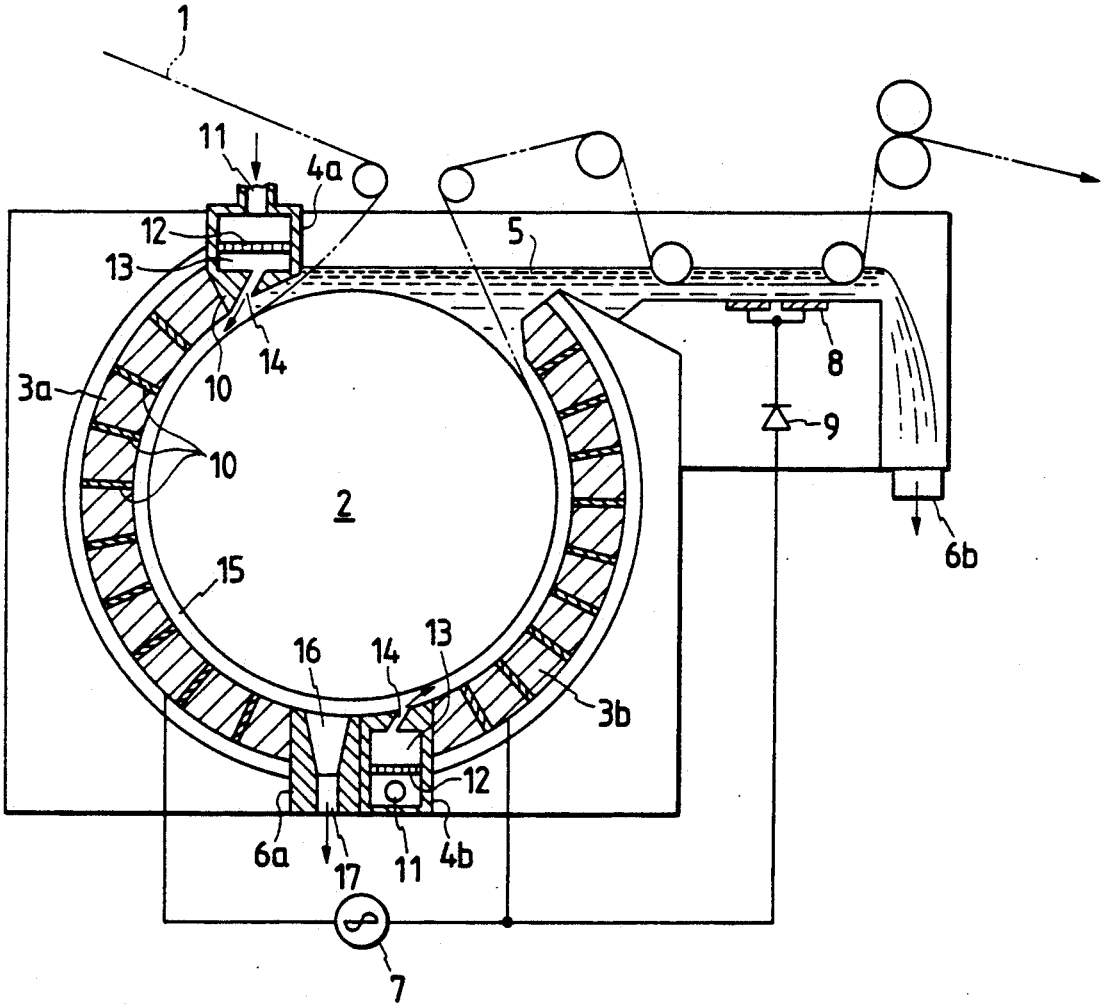
FIG. 1 is a side view showing an embodiment of the electrolytic treatment apparatus according to the present invention.

FIG. 1 shows an embodiment of the electrolytic treatment apparatus according to the present invention. Reference numeral 1 designates a metal web, and reference numeral 2 designates a radial drum roller for supporting the web 1. The metal web 1 is running while keeping a fixed clearance between the metal web 1 and each of main counter electrodes 3*a* and 3*b* and an auxiliary counter electrode 8. Usually, it is suitable to select the clearance to be about 3–50 mm. The charging rate of the main counter electrodes to the auxiliary counter electrode varies in accordance with required electrolytic etching conditions. Reference numeral 7 designates an AC power source. Usually, an AC power source having a frequency of 0.1 –500 Hz is used as the AC power source 7. Although the frequency is changed in accordance with a required etching mode, deterioration of the main counter electrodes 3*a* and 3*b* is large if the frequency is detected to be not higher than 15 Hz, and is remarkably large particularly in case of carbon electrodes. As the waveform, although various waveforms can be used, it is also possible to use a special alternating waveform as described in Japanese Patent Examined Publications No. Sho. 56-19280 and Sho. 55-19191. Reference numeral 9 designates a diode for controlling a current flowing in the auxiliary counter electrode 8. As the material of the auxiliary counter electrode 8, it is preferable to use platinum or ferrite which is durable against deterioration.

According to the present invention, an electrolyte supply inlet 4*b* is provided at the boundary between the main counter electrodes 3*a* and 3*b* in addition to, for example, a conventional electrolyte supply inlet 4*a*.

An electrolytic treatment solution 5 comes into the electrolyte supply inlets 4*a* and 4*b*, comes further into respective cavities 13 so as to be distributed uniformly over the whole in the direction of width of the radial drum roller 2, through corresponding distributors 12, and then is injected into an electrolyte path 15 through corresponding slits 14.

Although description has been made as to the case where an electrolyte supply inlet is provided between the counter electrodes in FIG. 1, one or more electrolyte supply inlets may be provided between the counter electrodes, and the position and structure of the electrolyte supply inlet are not limited to this embodiment.

According to the present invention, an electrolyte discharge outlet 6*a* is provided in front of the electrolyte supply inlet 4*b* corresponding to the electrolyte supply inlet 4*a* in addition, for example, to the conventional electrolyte discharge outlet 6.

In the electrolyte discharge outlet 6*a*, the electrolytic treatment solution 5 comes into a cavity 16 fully extended in the widthwise direction from the electrolyte path 15 so as to be discharged collectively through a discharge pipe 17.

Although description has been made as to the case where the electrolyte discharge outlets correspond to the electrolyte supply inlets in FIG. 1, it is not necessary that the number of electrolyte supply inlets be made equal to that of electrolyte discharge outlets. The electrolytic treatment solution supplied through a large number of supply inlets may be collectively discharged through one discharge outlet or through a plurality of discharge outlets. The important point is that the flowing-in/out quantity of the electrolytic treatment solution is increased by providing one or more electrolyte discharge outlets and one or more electrolyte supply inlets.

By the provision of one or more electrolyte discharge outlets and one or more electrolyte supply inlets, it is possible to increase the flowing-in/out quantity of the electrolyte treatment solution to thereby make it possible to realize uniformity in concentration and temperature of the electrolytic treatment solution owing to natural mixing and agitation of the electrolytic treatment solution, the uniformity in concentration and temperature of the electrolytic treatment solution being in contact with the metal web, the refreshment of the electrolytic treatment solution, and the temperature rising of the electrolytic treatment solution. As a result, it is possible to realize uniform and fine grains and to improve electrolysis efficiency to thereby increase the line speed.

EXAMPLE-1

By using such an apparatus as illustrated in FIG. 1, the electrolytic treatment solution was supplied at 3000 l/min in sum, that is, at 2500 l/min through the electrolyte supply inlet 4*a*, and at 500 l/min through the electrolyte supply inlet 4*b*, while the electrolytic treatment solution was discharged at 800 l/min through the electrolyte discharge outlet 6*a* and at 2200 l/min through the electrolyte discharge outlet 6*b*.

The conditions at this time were as follows:

| | |
|---|---|
| Main counter electrodes | carbon |
| Auxiliary counter electrode | platinum |
| Clearance between web and counter electrodes | 10 mm |

Conditions of the electrolytic treatment solution at the main electrodes:

| | |
|---|---|
| treatment solution | nitric acid |
| concentration | 50 g/l |
| temperature | 60° C. |

Conditions of the electrolytic treatment solution at the auxiliary electrode:

| | |
|---|---|
| treatment solution | nitric acid |
| concentration | 50 g/l |
| temperature | 20° C. |
| Web width | 1000 mm |
| Treatment speed | 15 m/min |
| Frequency | 100 Hz |

When graining was performed under the foregoing conditions, the outlet nitric acid concentration in the vicinity of the metal web was 48 g/l while the inlet nitric acid concentration of 50 g/l, and the outlet temperature in the vicinity of the metal web was 62° C. while the inlet temperature of 60° C., so that uniform and fine graining could be performed and the electrolysis efficiency could be raised.

COMPARATIVE EXAMPLE-1

Figure 2:
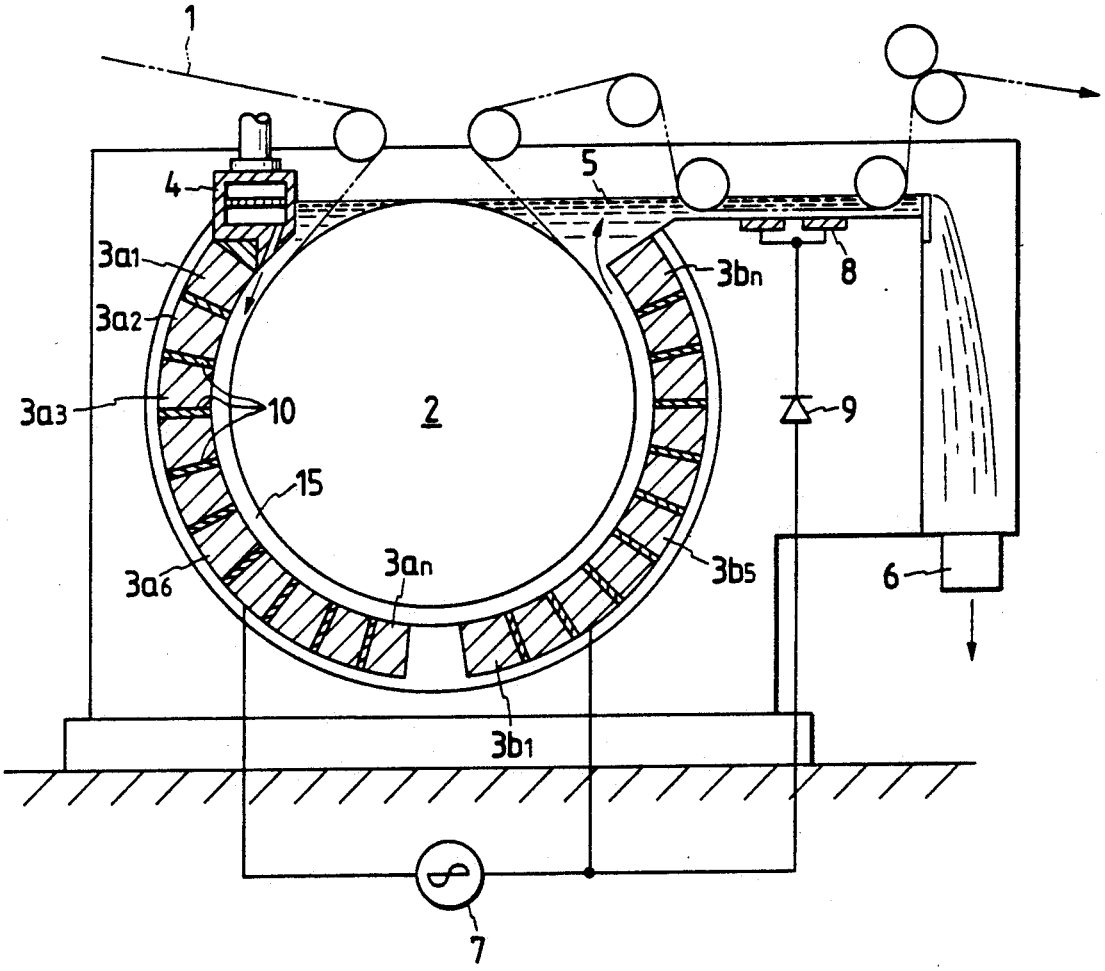
FIG. 2 PRIOR ART
FIG. 2 is a side view showing an example of the convention electrolytic treatment apparatus.

By using the apparatus of FIG. 2, treatment was performed under the same conditions as that in the Example-1. The upper limit of the rate of supply of the electrolytic treatment solution was 2500 l/min, and the inlet nitric acid concentration of 50 g/l was reduced to 40 g/l at the outlet in the vicinity of a metal web because the electrolytic treatment solution could not be uniformly mixed. Further, the outlet temperature in the vicinity of the metal web was 68° C. while the inlet temperature was 60° C. As a result, the products became non-conforming ones because of uneven grains.

As seen from the foregoing example, according to the present invention, one or more electrolyte discharge outlets and one or more electrode supply inlets are provided between the main counter electrodes so that the concentration and temperature of the electrolytic treatment solution at the inlets and at the outlets can be made close to each other. As a result, uniformity and fineness in grains can be maintained and electrolysis efficiency can be raised to thereby make it possible to improve the production speed. As a result, the present invention improves quality and reduces the cost of products.

I claim:

1. An electrolytic treatment apparatus comprising:

radial drum rolling means for supporting a metal web;

a plurality of main counter electrodes disposed in opposition to said metal web for effecting electrochemical treatment;

at least one auxiliary counter electrode disposed in opposition to said metal web;

AC power supply means for supplying AC power across said plurality of main counter electrodes;

at least one electrolyte supply inlet disposed between said main counter electrodes; and at least one electrolyte discharge outlet disposed between said main counter electrodes and adjacent to said at least one supply inlet, wherein an electrolyte treatment solution flows in an electrolyte path between said plurality of main counter electrodes and said metal web.

2. An electrolytic treatment apparatus as claimed in claim 1, wherein a fixed distance is maintained between said metal web and said plurality of main counter electrodes.

3. An electrolytic treatment apparatus as claimed in claim 2, wherein a distance between said metal web and said at least one auxiliary counter electrode is equal to the distance between said metal web and said plurality of main counter electrode.

4. An electrolytic treatment apparatus as claimed in claim 2, wherein said fixed distance is between 3 and 50 mm.

5. An electrolytic treatment apparatus as claimed in claim 1, wherein said AC power supply means has a frequency between 0.1 and 500 Hz.

6. An electrolytic treatment apparatus as claimed in claim 1, wherein a diode controls a current flowing in said at least one auxiliary counter electrode.

7. An electrolytic treatment apparatus as claimed in claim 1, wherein said auxiliary counter electrode is made of platinum or ferrite.

8. An electrolyte treatment apparatus as claimed in claim 1, wherein said at least one electrolyte discharge outlet is provided radially in front of said at least one electrolyte supply inlet such that fresh electrolyte treatment solution.

9. An electrolytic treatment apparatus as claimed in claim 1, wherein a number of said at least one electrolyte supply inlet equals a number of said at least one electrolyte discharge outlet.

10. An electrolytic treatment apparatus as claimed in claim 1, wherein a number of said at least one electrolyte supply inlet exceeds a number of said at least one electrolyte discharge outlet.

11. An electrolytic treatment apparatus as claimed in claim 1, wherein a number of said at least one electrolyte supply inlet is less than a number of said at least one electrolyte discharge outlet.

12. An electrolytic treatment apparatus as claimed in claims 2 or 3, wherein said electrolyte is supplied at 2500 l/min through a first electrolyte supply inlet and at 500 l/min through a second electrolyte supply inlet;

said electrolyte is discharged at 800 l/min through a first electrolyte discharge outlet and at 2200 l/min through a second electrolyte discharge outlet;

said plurality of main counter electrodes are made of carbon;

said at least one auxiliary counter electrode is made of at least one of platinum and Ferrite; and wherein said fixed distance is 10 mm.

13. An electrolytic treatment apparatus as claimed in claim 12, wherein said electrolyte treatment solution at said plurality of main counter electrodes comprises nitric acid at a concentration of 50 g/l and at a temperature of 60° C.

14. An electrolytic treatment apparatus as claimed in claim 13, wherein said electrolyte treatment solution at said at least one auxiliary counter electrode comprises nitric acid at a concentration of 50 g/l and at a temperature of 20° C.

15. An electrolytic treatment apparatus as claimed in claim 14, wherein a width of said metal web is 100 mm, and said AC power supply means has a frequency of 100 Hz.

16. An electrolytic treatment apparatus as claimed in claim 1, wherein said at least one electrolyte discharge outlet includes a cavity fully extended in a width-wise direction from said electrolyte path such that said electrolyte treatment solution is collectively discharged through a corresponding discharge pipe.

* * * * *